United States Patent [19]

Bender et al.

[11] Patent Number: 4,651,934

[45] Date of Patent: Mar. 24, 1987

[54] PULVERIZING MILL

[76] Inventors: Martin P. Bender; Robert E. Rochelle, both c/o Fluid Air, Inc., 540 Industrial Dr., Naperville, Ill. 60566

[21] Appl. No.: 698,918

[22] Filed: Feb. 6, 1985

[51] Int. Cl.[4] ..... B02C 13/28

[52] U.S. Cl. ..... 241/36; 241/73; 241/189 A; 241/191; 241/285 R

[58] Field of Search ..... 241/285 R, 191, 285 A, 241/195, 285 B, 197, 36, 37.5, 73, 189 R, 189 A, 188 R, 188 A

[56] References Cited

U.S. PATENT DOCUMENTS

| | | | |
|---|---|---|---|
| 1,171,747 | 2/1916 | Newhouse | 241/189 R |
| 1,215,075 | 2/1917 | Sturtevant | 241/188 R X |
| 2,033,757 | 3/1936 | Crites | 241/188 A X |
| 2,492,872 | 12/1949 | Knight | 241/189 A X |
| 2,546,286 | 3/1951 | Zakel | 241/191 X |
| 2,664,128 | 12/1953 | Braunwalder et al. | 241/37.5 |
| 2,934,116 | 4/1960 | Dannenmann | 241/37.5 |
| 3,623,673 | 11/1971 | Math et al. | 241/36 |
| 4,043,514 | 8/1977 | Peterson, Jr. | 241/285 B X |

*Primary Examiner*—Mark Rosenbaum

[57] ABSTRACT

A pulverizing mill is disclosed, suitable for wet or dry foodstuffs, chemicals, plastics and pharmaceuticals, having a reversible welded multi-bladed rotor which is substantially seamless and crack-free so as not to catch and retain particles of the material being pulverized. The rotor blades are supported parallel to the rotor's central axis in a picket-fence configuration in which blade position are staggered from one rotor segment to the next whereby the entire rotor shaft internal volume is swept by one or more blades during each revolution. The blades are supported at predetermined points which raise the rotor maximum safe operating to achieve a higher output of pulverized product. The mill inlet housing is attached by quick-release toggle fasteners associated with fiber-optic sensing means to prevent mill operation unless the housing is fully secured in one of two proper operating positions. The sensing means is associated with control circuitry which automatically ensures proper rotor rotation with respect to the inlet housing position to prevent blow-back of pulverized material.

7 Claims, 8 Drawing Figures

FIG. 1
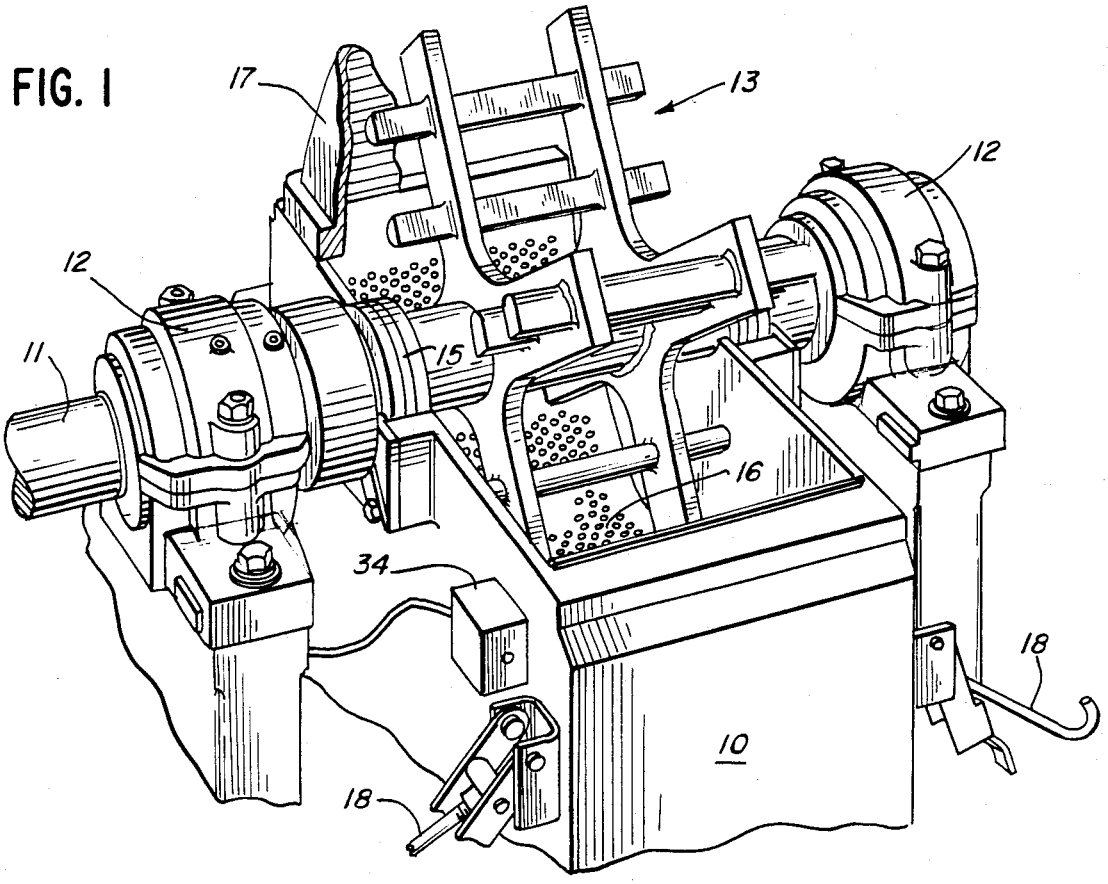
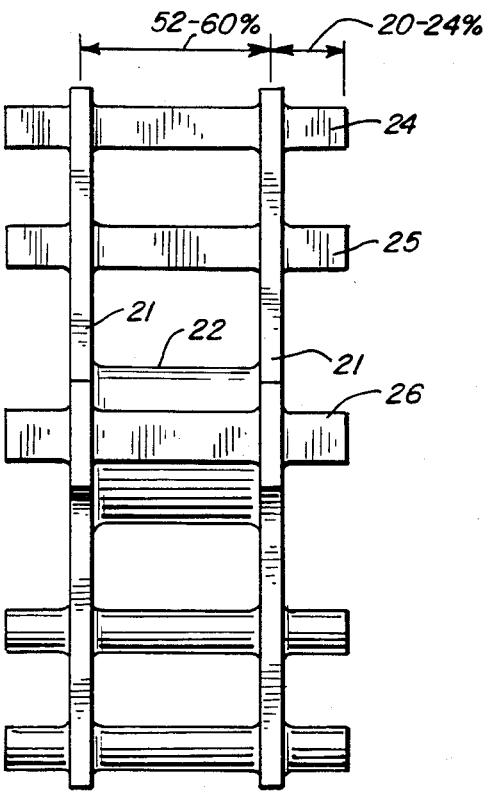
FIG. 2A
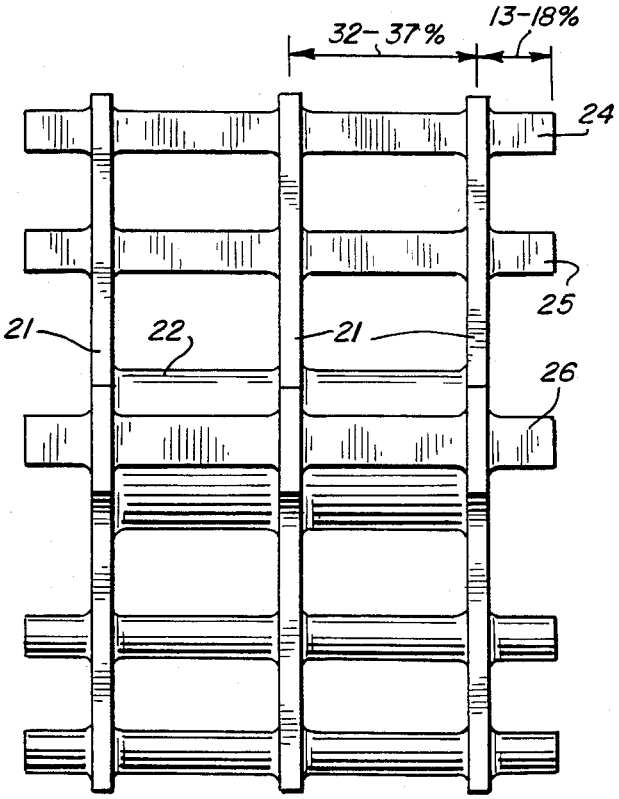
FIG. 2B

FIG. 3
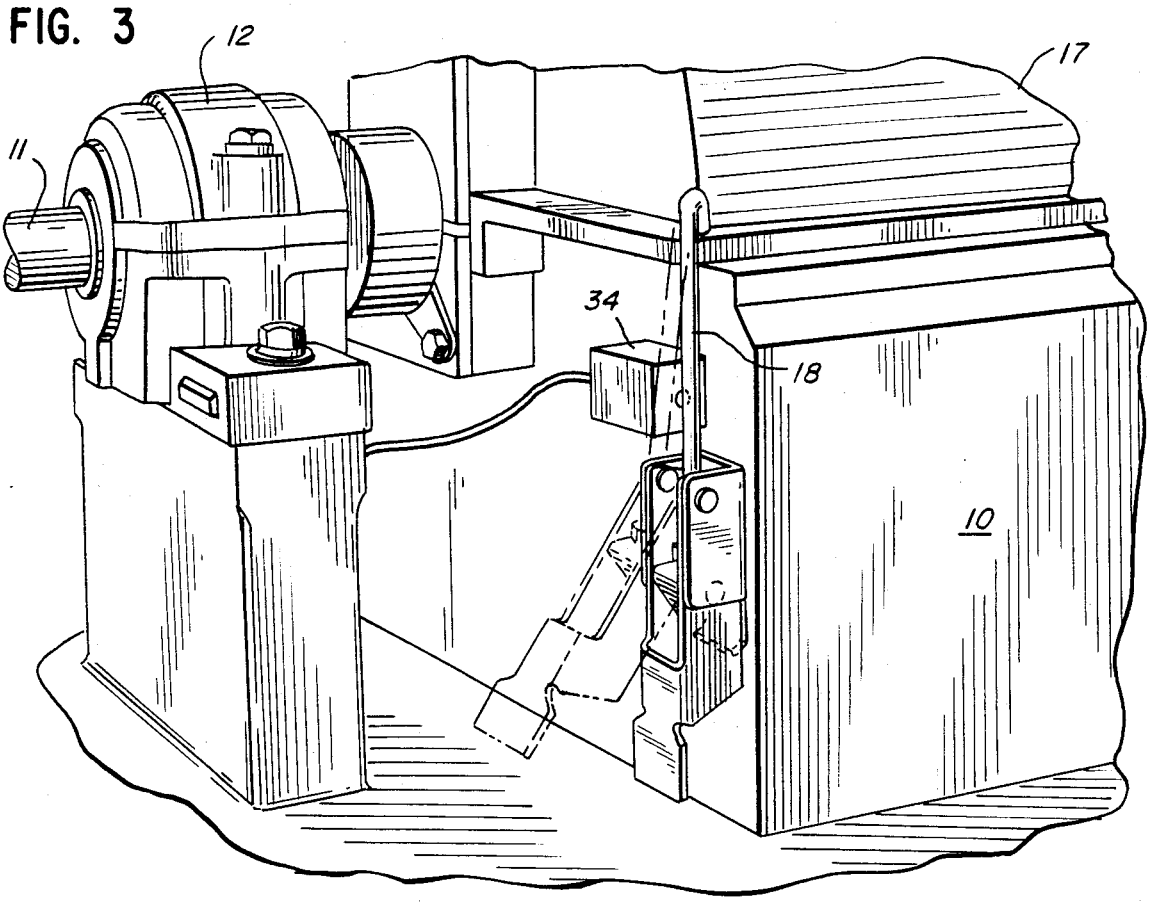
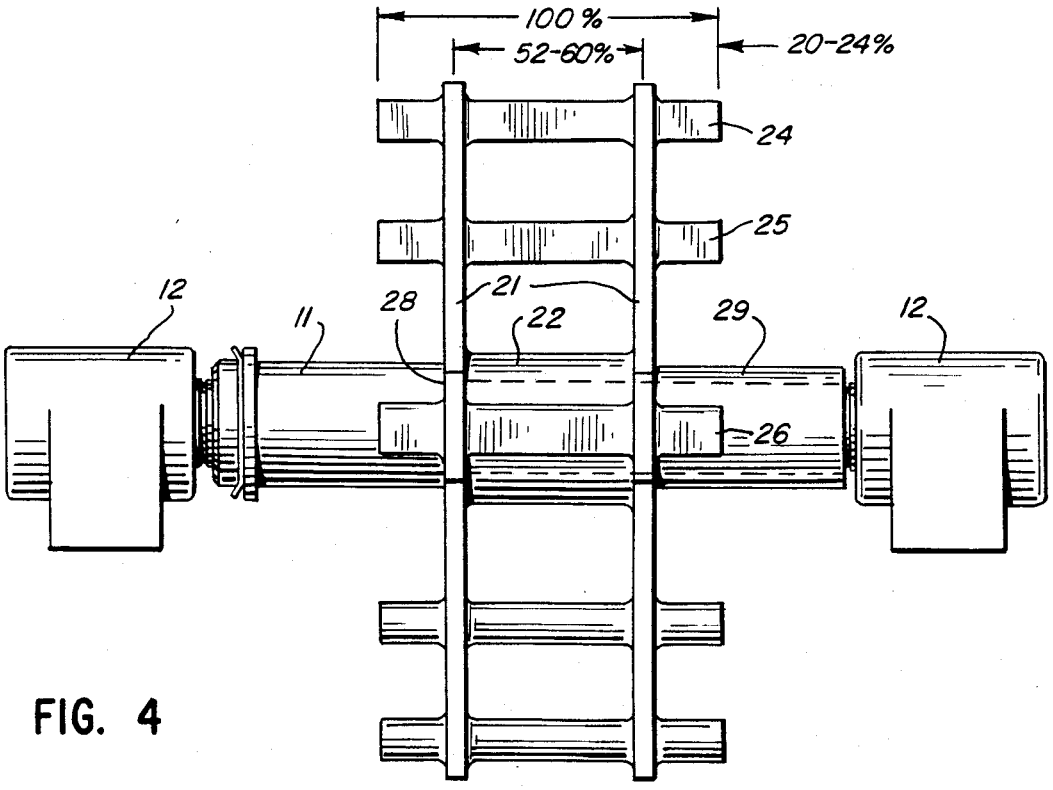
FIG. 4

FIG. 5
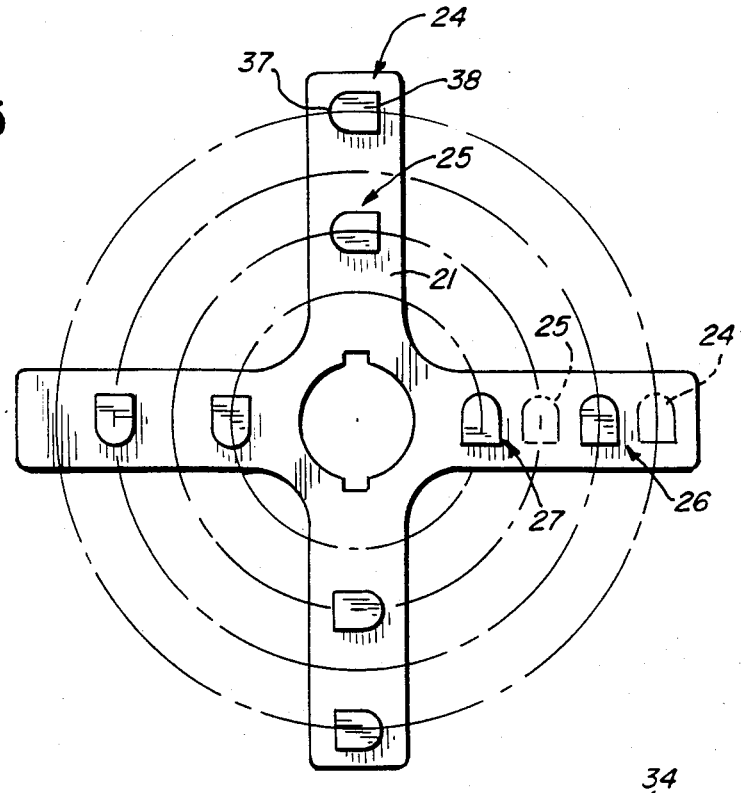
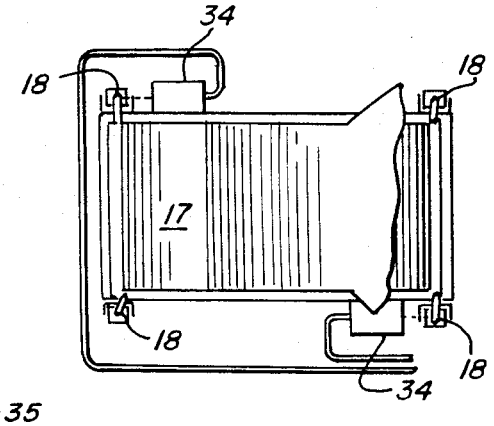
FIG. 7
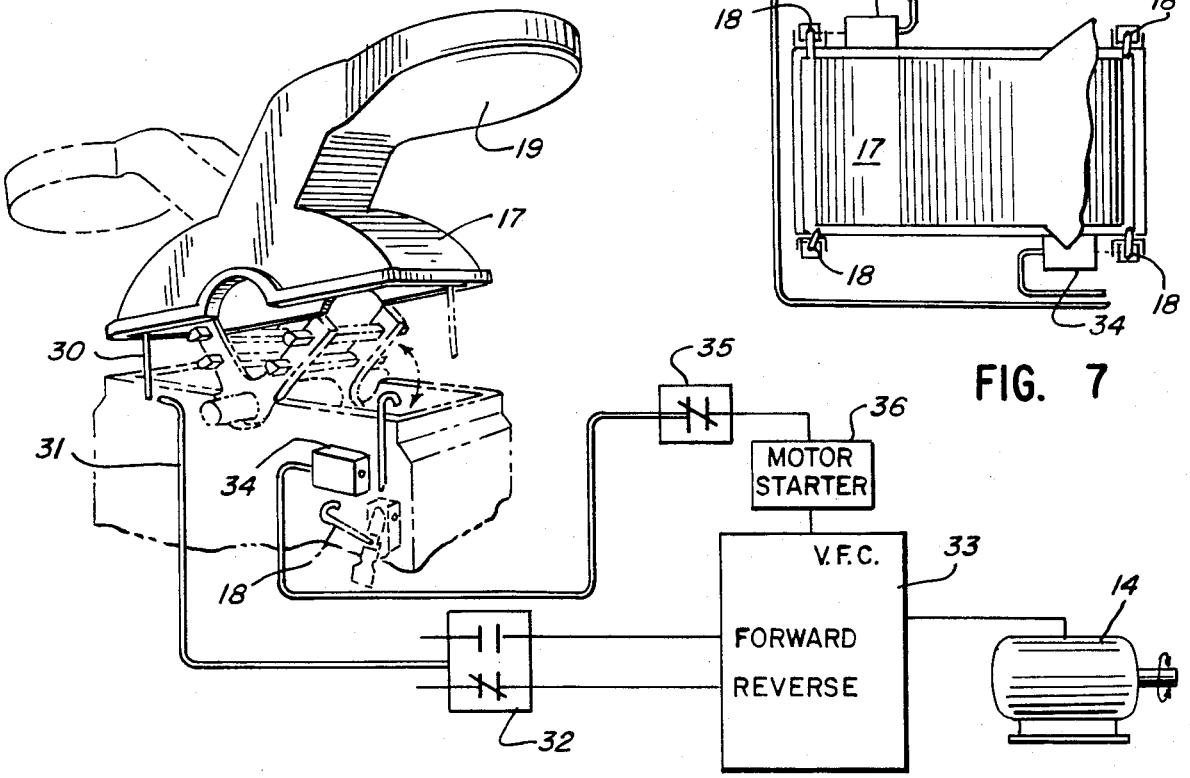
FIG. 6

PULVERIZING MILL

BACKGROUND OF THE INVENTION

Pulverizing mills are used in a variety of applications to reduce particle size in wet or dry foodstuffs, chemicals, plastics and pharmaceutical materials. Such machines typically are constructed as hammer mills, with the feed material being introduced through an inlet housing to a chamber where the pulverizing or communiting is accomplished, and with the pulverized material discharging through a screened opening into a suitable receptacle. Such prior art machines are typically illustrated in the following U.S. patents:

Magnus U.S. Pat. No. 2,348,916 (May 16, 1944)
Gruendler U.S. Pat. No. 2,969,820 (Jan. 31, 1961)
Kircher, Jr. U.S. Pat. No. 3,051,400 (Aug. 28, 1962)
Joseph, et al U.S. Pat. No. 3,088,683 (May 7, 1963)
Fitz U.S. Pat. No. 3,184,172 (May 18, 1965)
MacElvain, et al U.S. Pat. No. 4,098,466 (July 4, 1978)

Mills of the sort typified by the foregoing prior art patents are not always suitable for certain kinds of foodstuff and pharmaceutical processing for several reasons.

First, there exist strict rules with respect to cleanliness and sanitation for equipment used in food and drug processing. For example, Title 21 C.F.R. section 110.40(a) (1984) requires all plant equipment and utensils used in processing food for human consumption to be so designed and of such material and workmanship as to be adequately cleanable, and to be so installed and maintained as to facilitate the cleaning of the equipment and of all adjacent spaces. Devices such as those shown in the above patents typically contain multiple moving parts such as swinging arms, blades and the like, with numerous pivots, joints and crevices which tend to catch and retain particles of material.

Second, it is often important to prevent excessive buildup of heat in the product as it passes through the mill, in order to avoid adverse physical and chemical changes. This requirement cannot always be met with a mill that depends on multiple recirculation of the material through the mill, as opposed to substantially once-through processing where the majority of the material is reduced to the desired size in just one pass.

Third, it is desirable to be able to use the same mill for different products without the need to disassemble the entire unit for the purpose of changing impact bars or blades.

Finally, safety considerations often require that the mill's power source be positively locked out when the mill is open for cleaning or other maintenance. At the same time it is often desirable to reverse the direction of mill rotation to utilize the opposite face of the rotor, which may have a different contour. This requires that the inlet housing be repositioned in the opposite direction to prevent blow-back of product through the inlet opening, and care must be taken in insure that the mill is not inadvertently driven in the wrong direction after reassembly.

In view of the foregoing considerations, it is a principal object of the present invention to provide an improved impact or pulverizing mill which has a unitary and substantially crevice-free rotor which is easily cleanable and requires little or no disassembly or maintenance.

It is a further object of the invention to provide such a mill which is capable of using different blade lengths, but which is still capable of relatively high speed operation with substantially once-through passage of feed material, so as to avoid unnecessary heat build-up in the product.

Another object and feature of the invention is to provide a mill which is quickly and easily opened for cleaning and maintenance, and which is provided with safety interlocks to prevent the mill from being accidentally started if the inlet housing is not positively secured in proper position for operation.

A related object of the invention is to provide for reversible rotation of the mill by merely removing and repositioning the inlet housing, and to provide for the direction of operation to be automatically determined upon reassemble of the inlet housing in the desired position.

DESCRIPTION OF THE DRAWINGS

FIG. 1 is a perspective view of the improved mill of the invention, with the inlet housing broken away to show the rotor and impact blades, the discharge screen, and showing the inlet cover hold-down latches disengaged.

FIG. 2A is a side elevation of the rotor from the mill of FIG. 1, showing the rotor side plate or disk positions with respect to the impact blades.

FIG. 2B is a side elevation similar to FIG. 2A showing an alternative embodiment of the rotor, having three disks instead of two, for the purpose of supporting longer impact blades.

FIG. 3 is another perspective view of the mill similar to FIG. 1, with the hold-down latches engaged to activate an optical cover engagement detection system.

FIG. 4 is a side elevation of the rotor and shaft assembly of the mill of FIG. 1.

FIG. 5 is is an end elevation of the rotors of FIG. 2A or 2B, showing the different radial positions of the blades on alternate arms of the rotor disks.

FIG. 6 is a combined perspective and block schematic diagram illustrating the inlet housing and feed chute of the mill of FIG. 1 in relationship to the optical position detection and motor control system of the invention.

FIG. 7 is a partial schematic diagram of the optical hold-down engagement detection system of the invention.

DETAILED DESCRIPTION OF THE INVENTION

Referring to the drawings, there is shown in FIG. 1 a pulverizing mill embodying the improvements of the invention. The mill housing consists of a body shell 10 into which a shaft 11 extends, supported for rotation by bearing blocks 12. Carried by and keyed to the shaft 11 is a rotor assembly 13 which is driven by the shaft 11 from a motor or other power source 14 (FIG. 6). The shaft 11 penetrates the mill housing through openings provided with seal means 15 to prevent the escape of pulverized material or the entry of ambient air. Such as seal means is sold as "V-ring packing" by Halogen Insulation and Seal Corp. of Elk Grove, Ill.

A discharge screen 16 permits pulverized material of the desired fineness to pass through a discharge opening (not shown) beneath the body shell and into a bag, receptacle, or closed conveying system. A breathable fabric flexible connector is generally used between the discharge opening and bag or receptacle to retain product dust while allowing heat and excess air to escape.

An inlet shell 17 (best shown in FIG. 6, and shown broken away in FIG. 1) is secured to the body shell 10 by quick-release fasteners 18 located at the four corners of the inlet shell 17, which in the illustrated embodiment consist of manually operated toggle clamps. Referring to FIG. 6, it can be seen that the inlet shell 17 includes a chute 19 through which feed material may be directed into the rapidly turning rotor 13. Other alternate inlets may incorporate feed screws, liquid connectors, pneumatic conveyors, or gravity feed chutes and hoppers, without departing from the purpose and scope of the invention.

As best shown in FIGS. 2A, 2B, 5 and 4, the rotor 13 consists of two or more blade-holding disks 21 positioned in spaced relationship and connected at their hubs by a central hub sleeve 22. The rotor is fabricated by welding from a corrosion-resistant material such as 17-4PH stainless steel. Each disk 21 is provided with axial holes or penetrations through which individual pulverizing blades 24, 25, 26 and 27 are positioned in a characteristic "picket-fence" pattern and then welded in place.

As is best shown in FIG. 4, the rotor 13 slides over one end of the shaft 11 and abuts a shoulder 28. A spacer sleeve 29 slides over the protruding end of the shaft 11 and is secured by conventional means such as a lock nut and lockwasher (not shown).

All welds in the completed rotor assembly 13 are preferably finished by grinding to a smooth finish so that the unit has no joints or crevices where pulverized material might be caught and retained. In the rotating elements which contact the feed material, the only crevices are at the joints between the rotor 13 and shaft shoulder 28 at one end, and the spacer sleeve 29 at the other. These joints are easily separated for cleaning and may be fitted with gaskets (not shown) if desired. The rotor 13 is is rotationally locked to the shaft 11 by conventional means such as a key or spline (not shown).

According to the invention, and as best shown in FIGS. 2A and 4, the rotor blades 24, 25, 26, and 27 are supported by the two disks 21 at points intermediate their ends. The invention provides for maximum rotor speed with such a two-disk construction when each blade is supported inward of its ends with 52% to 60% of total blade length being supported between disks, and 20% to 24% of total blade length being cantilevered from its supporting disk.

For example, a typical two-disk rotor constructed according to the invention has disks $\frac{3}{8}$ inch thick, a shaft 2 inches in diameter, and a blade length of 7 inches. Two pairs of blades 24, 25 are located in a first disk plane at $3\frac{3}{8}$ inches and $4\frac{3}{8}$ inches from the rotational axis. The remaining blade pairs 26, 27 are positioned $5\frac{5}{8}$ inches and $6\frac{5}{8}$ inches from the rotational axis.

The outermost blade 26 is subject to the greatest centrifugal force, and also to a small force component in a radial direction due to impact with the material being pulverized. Sufficient disk strength must also be provided at the outermost penetrations 23 to hold the outermost blades 24, and therefore a projecting tip length of at least 9/32 inch has been provided in the illustrated example.

With a maximum allowable design stress of 75,000 psi, a rotor constructed according to the present invention with a seven inch overall blade length can achieve a speed of 11,800 rpm. Higher rotational speed is desirable because the torque required to drive the rotor 13 is less than at lower speeds where the blade loading is proportionately greater for a constant throughput of product.

A rotor with longer blade lengths and correspondingly greater material handling capacity can be constructed using three disks, as shown in FIG. 2B. In this embodiment, a blade length of 21 inches has been selected, with the blades being radially positioned in the same manner as in the preceding two-disk example.

The invention provides for maximum rotor speed with such a three-disk construction when each 21 inch blade is supported inward of its ends with 32% to 37% of total blade length being supported between adjacent disks, and 13% to 18% of total blade length being cantilevered from each outer supporting disk. This construction allows rotor speeds of up to 6,100 rpm, compared to the stress-limited speed of approximately 4,000 rpm when such 21 inch blades are supported by only two disks.

Further according to the invention, and as best shown in FIG. 5, the blades 24, 25 are positioned on a first disk plane, and the remaining blades 26, 27 are positioned on a second disk plane rotated 90 degrees from the first. Two blades are positioned in each disk plane. The blades 24, 25 sweep a portion of the internal volume of the rotor as determined by their width and radial distance from the axis of rotation. The following tier of blades 26, 27 is positioned radially from the axis of rotation to sweep through the remaining space or internal rotor volume not swept by the preceding blades 24, 25, rather than merely following in the same path.

By utilizing this rotor construction substantially the entire internal volume of the rotor is swept in each rotor revolution, and a particle of feed material entering the inlet housing cannot escape being impacted by at least one of the moving blades. Stated another way, each incoming particle of feed material is met by a virtual "wall of steel" at least once, and preferably twice, in each revolution.

It is an advantage of the invention that the probability of achieving the desired size reduction in a single pass through the rotor is substantially increased, so that the pulverized material may fall directly though the discharge screen 14 without being recycled for another pass through the rotor. The resulting speed and efficiency of pulverization has been found to significantly reduce motor power requirements and lowers the tendency toward heat buildup in the finished material, which is a great advantage for certain heat-sensitive foodstuffs and pharmaceuticals.

According to another feature of the invention, the mating surfaces of the body shell 10 and inlet shell 17 are symmetrical and reversible. The inlet shell 17 can be assembled to the body shell 10 in a first preferred position with respect to rotor rotation, and can also be assembled in a second position with the inlet shell 17 rotated 180 degrees from the first position.

The direction of rotor rotation dictates the preferred position of the inlet shell 17 as shown in FIG. 6. When movement is in a counter-clockwise direction, the inlet chute 19 (solid lines) should direct the incoming feed material tangentially and in the same direction as the movement of the rotor blades to minimize blow-back of pulverized material into the inlet chute 19. When the inlet shell 17 is reversed (broken lines), the direction of rotor rotation should be similarly reversed for the same reason.

In the present invention, this result is achieved by providing a keying element in the form of an indicator tab 30 at a predetermined location on the inlet housing 17, and a first sensing means 31 connected to a relay means 32 which controls the motor starting means 33. When the tab is detected in the location for clockwise running, the relay means 33 signals the motor starting means for starting in this direction. When the tab is not detected, the starting means is signalled for opposite rotation. In this manner the direction of motor rotation, and thereby rotor rotation, is automatically selected to correspond to the position of the inlet shell 17. The motor 14 therefore cannot be started in the wrong direction which might force feed material and pulverized product back through the inlet chute 19 rather than out through the discharge screen 16.

Each sensing means 31 of the illustrated embodiment preferably consists of a fiber-optic light transmission bundle, commonly known as a "light pipe", cooperating with a photoelectrically responsive device in the relay means 32.

As another feature of the invention, a safety interlock is provided to prevent mill operation when the inlet housing is not securely locked in place by the toggle clamps or other fasteners 18. Second sensing means 34 are provided adjacent at least two clamps 18 at diametrically opposite corners of the body shell 10 (FIG. 7). When the clamp fasteners 18 are in proper position to secure the inlet housing to the body housing, each of the sensing means 34 must detect the existence of a latched condition at the opposed corners of the inlet shell 17 and convey a suitable signal to a second relay means 35, which permits the motor starter 36 to be energized. Should one or more of the fasteners loosen during operation, the motor is automatically deenergized by the same means.

A second advantage flowing from this feature of the invention is that the rotor 13 can be constructed for bidirectional rotation. Each blade can be formed with a first impact surface 37 (FIG. 5) and a second impact surface 38 on its opposite side, with the selection of the surface to be used being determined merely by selecting the direction of rotation.

The surfaces 37, 38 are preferably made with differing contours as shown in FIG. 5 to provide versatility in handling different kinds of feed material. Alternatively, the impact surfaces 37, 38 may be made identical (not shown) for the purpose of providing longer rotor life in milling abrasive materials by simply reversing the direction of mill rotation from time to time.

We claim:

1. A pulverizing mill comprising housing means including an inlet shell and a body shell in separable relationship, a shaft, and bearing and seal means for retaining the shaft for rotation within the housing means and defining a rotor axis, and a rotor secured to the shaft within the housing means, the rotor comprising at least two spaced parallel blade-holding rotor side plates, each being affixed to the shaft for rotation therewith first and second sets of pulverizing blades, each secured at both ends to the rotor side plates parallel to the rotor axis and supported for rotation with the shaft within the housing, said first blades spaced from the axis to define a first swept portion of the internal volume of the housing, said second blades being radially and angularly offset from the first blades to define a second swept portion of the internal volume of the housing, the combined first and second swept volumes comprising substantially the entire internal volume of the rotor.

2. The pulverizing mill of claim 1 in which each blade is formed with an advancing edge and a receding edge with respect to a first direction of rotor rotation, and in which the receding edge is configured as an advancing edge for rotation in the opposite direction.

3. The pulverizing mill of claim 1 in which each blade is supported by rotor side plates at at least two points intermediate its ends, and the rotor side plates are spaced such that each blade is supported inward of its ends with 52% to 60% of total blade length being supported between rotor side plates, and 20% to 24% of total blade length being cantilevered from its supporting rotor side plate.

4. The pulverizing mill of claim 1 in which each blade is supported by rotor side plates at three points intermediate its ends and the three rotor side plates are spaced such that each blade id supported inward of its ends with 32% to 37% of total blade length being supported between adjacent side plates, and 13% to 18% of total blade length being cantilevered from each endmost supporting rotor side plate.

5. The pulverizing mill of claim 1 in which the rotor disks include penetrations into which the blades are recieved, and a hollow cylindrical central core into which the shaft is received, and in which the core, disks and blades are of weldable metal and fabricated by welding into an integral unit with no cracks or joints to catch and retain pulverized material.

6. The pulverizing mill of claim 1 in which the lower body shell includes screen means for discharging pulverized product of predetermined size while retaining product of greater size within the housing for further pulverization.

7. In a pulverizing mill having housing means including an inlet shell and a body shell in separable relationship, with the inlet shell being reversible with respect to the body shell, the housing means including screen means for discharging pulverized product of predetermined size while retaining product of greater size within the housing for further pulverization, a shaft, bearing and seal means for retaining the shaft for rotation within the housing means and defining a rotor axis, reversible rotor means within the housing for pulverizing a product introduced through the inlet shell and discharging pulverized product from the body shell through the screen, and reversible motor means for driving the shaft and rotor, the improvement comprising latch means for reversibly securing the inlet shell to the body shell, detector means for detecting the position of the inlet shell with respect to the body shell when secured by the latch means, and motor control means responsive to the detector means for reversing the direction of motor rotation when the inlet shell is mounted to the body shell in reversed position.

* * * * *